United States Patent [19]

Kiselewski

[11] Patent Number: 4,733,512

[45] Date of Patent: Mar. 29, 1988

[54] MODULAR STRUCTURE, STUD THEREFOR, AND METHOD OF CONSTRUCTION

[76] Inventor: Donald L. Kiselewski, 4705 Holly Dr., Palm Beach Gardens, Fla. 33410

[21] Appl. No.: 907,785

[22] Filed: Sep. 16, 1986

Related U.S. Application Data

[62] Division of Ser. No. 774,663, Sep. 11, 1985, Pat. No. 4,648,228, which is a division of Ser. No. 470,160, Feb. 28, 1983, Pat. No. 4,551,961.

[51] Int. Cl.[4] ..... E04H 1/00

[52] U.S. Cl. ..... 52/238.1; 52/264

[58] Field of Search ..... 52/264, 241, 773, 774, 52/778, 779, 242, 243, 481, 238.1

[56] References Cited

U.S. PATENT DOCUMENTS

| | | | |
|---|---|---|---|
| 3,608,258 | 9/1971 | Spratt | 52/241 |
| 3,623,288 | 11/1971 | Horowitz | 52/264 |
| 4,109,430 | 8/1978 | Fuller | 52/241 X |
| 4,231,197 | 11/1980 | Caplan et al. | 52/241 X |
| 4,361,994 | 12/1982 | Carver | 52/238.1 |
| 4,381,632 | 5/1983 | Geitner | 52/264 X |

FOREIGN PATENT DOCUMENTS

| | | | |
|---|---|---|---|
| 789379 | 1/1958 | United Kingdom | 52/241 |

*Primary Examiner*—Carl D. Friedman

*Attorney, Agent, or Firm*—Wood, Dalton, Phillips, Mason & Rowe

[57] ABSTRACT

A modular structure, stud therefor, and method of construction are disclosed. The modular structure includes a wall formed of an inner and outer panel defining a cavity therebetween. The stud may be disposed between the inner and outer panels with one of the panels being secured to a first portion of the stud and the other of the panels being secured to a second portion of the stud such that the first and second portions are relatively movable but may be interlocked in a fixed position within the cavity such that the inner and outer panels of the wall can be maintained in spaced apart relationship by a preselected distance. The method of construction includes placing one modular structure on top of another. Additionally, the present invention contemplates the use of retainers for maintaining a wall in a selected position relative to a floor and ceiling.

5 Claims, 8 Drawing Figures

MODULAR STRUCTURE, STUD THEREFOR, AND METHOD OF CONSTRUCTION

This is a division of application Ser. No. 774,663 filed Sept. 11, 1985 now U.S. Pat. No. 4,648,228 which is a division of Ser. No. 470,160, filed Feb. 28, 1983 now U.S. Pat. No. 4,551,961.

BACKGROUND OF THE INVENTION

The present invention relates to a modular structure, stud therefor, and method of construction and, more particularly, to a new and unique structure, stud and method having many advantageous features.

In recent years, there has been a growing recognition of the need for modular structures for a variety of applications. These include applications such as housing, storage, education, banking and the like, but among the most urgent areas of need for modular structures is within the penal systems which have experienced severe overcrowding and have been forced by court orders to allow prisoners back into society before their scheduled release to reduce overcrowding and otherwise improve conditions in jails and prisons. However, despite the need, the fact remains that modular structures that are entirely satisfactory in every respect as permanent buildings are at best uncommon.

Among the problems with modular structures that have been proposed is the prevailing attitude that they are merely temporary buildings. Oftentimes, a proposed modular structure is of substantially less sound construction than a corresponding permanent structure. It has also been a problem to reduce costs and expedite construction due to the inherent characteristics of modular structures. They have not for the most part permitted an orderly method of construction in which the various steps in assembling such structures can be performed at the most suitable locations, e.g., where a shell can be shipped by reason of its relatively low weight and concrete can be poured on site to add the needed stability. It has also been a problem to provide a completely finished building that can be occupied immediately after erection on a foundation at a selected site. Accordingly, proposed modular structures usually do not result in the economies expected in contrast to corresponding permanent structures. In view of this, there has been a reluctance to utilize modular structures even where their use would otherwise be advantageous.

SUMMARY OF THE INVENTION

Accordingly, it is an object of the present invention to provide a modular structure, stud therefor, and method of construction capable of overcoming the problems previously encountered in this field.

In an exemplary embodiment, the modular structure includes a wall formed of an inner and outer panel defining a cavity therebetween. At least one stud is disposed between the inner and outer panels, one of the panels preferably being secured to a first portion of the stud and the other of the panels preferably being secured to a second portion of the stud with the first and second portions being relatively movable and including means for interlocking the first and second portions in a fixed position within the cavity. With this construction, the modular structure is formed so that the inner and outer panels of the wall may be maintained in spaced apart relationship by a preselected distance.

In a preferred embodiment, the modular structure includes a plurality of walls defining the perimeter of the structure. A plurality of studs are then disposed between the inner and outer panels forming each of the walls with the studs being as defined in connection with the exemplary embodiment so that the inner and outer panels of such walls may all be maintained in spaced apart relation by a preselected distance. Moreover, the modular structure includes floor and ceiling panels substantially coextensive with the perimeter of the structure and intergrally associated with the bottom and top of the walls, respectively.

With regard to the stud, it suitably includes a first portion to which an inner panel is adapted to be secured and a second portion to which an outer panel is adapted to be secured. The first and second portions are substantially identical to one another with each such portion having a mounting flange with a web extending therefrom such that the first portion web extends toward the outer panel and the second portion web extends toward the inner panel when the inner and outer panels have been secured to the first and second portions to form a wall. In addition, the first portion advantageously has means for interlocking engagement with means of the second portion of the stud.

As will be appreciated, the method of constructing a modular structure comprises a number of steps. First, an inner and outer panel and a stud having first and second portions are provided after which the inner panel is secured to one of the first and second portions and the outer panel is secured to the other of the first and second portions. Then, the inner and outer panels are positioned in spaced parallel relationship with the first and second portions of the stud in confronting relatively movable relationship to form a wall having a cavity therein. Finally, the first and second portions are interlocked in a fixed position within the cavity such that the inner and outer panels are maintained in spaced apart relationship by a preselected distance. With this method of construction, another modular structure may be placed on top of the modular structure so formed.

These and other objects, advantages and features of the present invention will be appreciated from a consideration of the details set forth in the accompanying specification, claims and drawings.

BRIEF DESCRIPTION OF THE DRAWINGS

The features of the present invention which are believed to be novel are set forth with particularity in the appended claims. The invention, together with its objects, advantages and features, may be best understood by reference to the following description taken in conjunction with the accompanying drawings. In the accompanying drawings, like reference numerals identify like elements in the several figures in which:

DETAILED DESCRIPTION OF THE PREFERRED EMBODIMENTS

Figure 1:
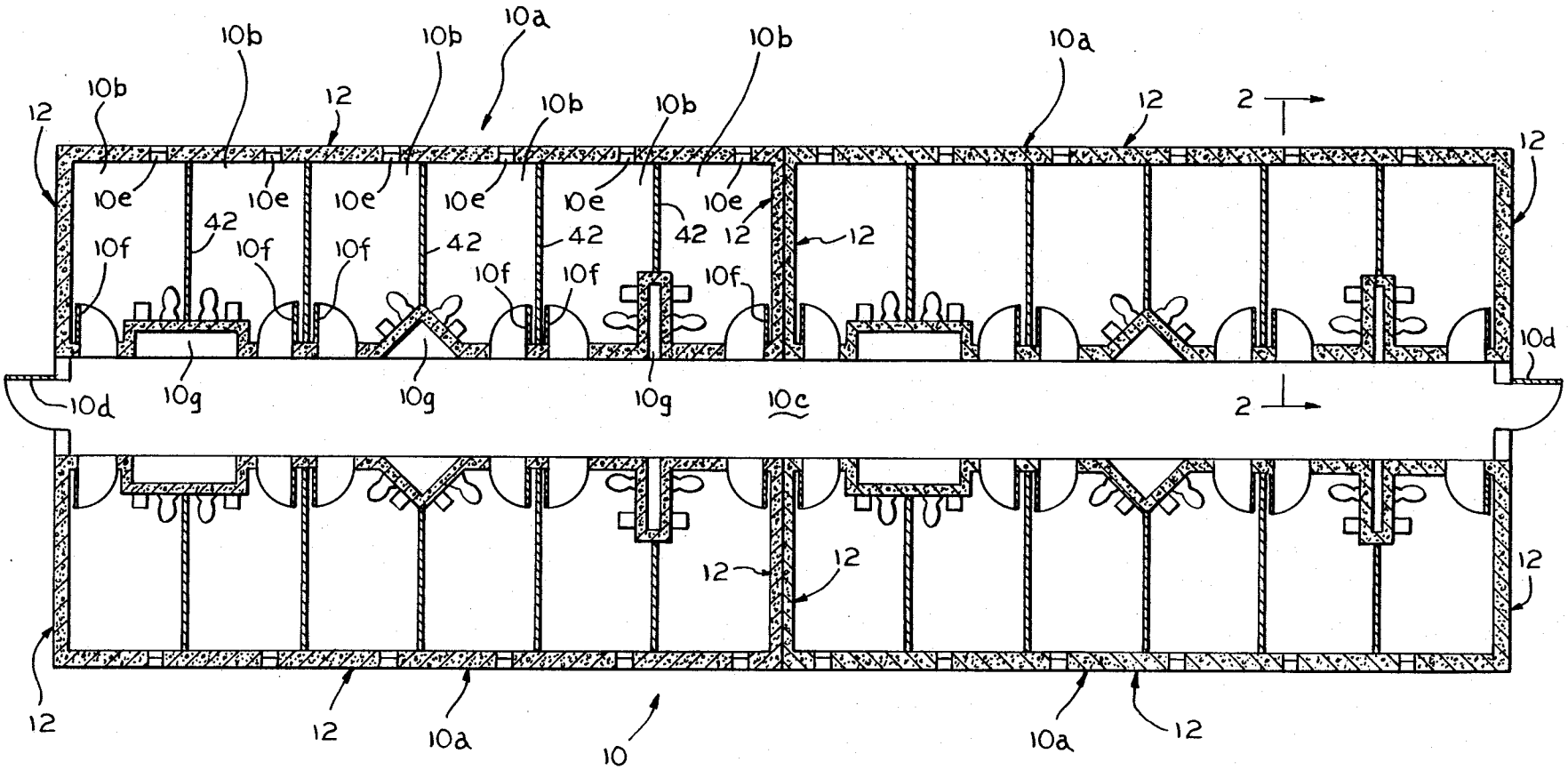
FIG. 1 is a typical floor plan of a modular structure constructed in accordance with the present invention.

In the illustration given, and with reference first to FIG. 1, the reference numeral 10 designates generally a modular structure in accordance with the present invention. The modular structure includes one or more walls 12 (also see FIG. 2) formed of an inner panel 14 and an outer panel 16 defining a cavity therebetween. At least one stud 18 is disposed between the inner and outer panels 14 and 16, one of the panels 14 preferably being secured to a first portion 18*a* of the stud 18 and the other of the panels 16 preferably being secured to a second portion 18*b* of the stud 18 with the first and second portions 18*a* and 18*b* being relatively movable and including means for interlocking the first and second portions of the stud in a fixed position within the cavity 20 (see FIG. 4). The modular structure is formed so that the inner and outer panels 14 and 16 of the wall 12 may be maintained in spaced apart relationship by a preselected distance. Moreover, as will be appreciated by referring to FIGS. 2 through 4, this is advantageously accomplished in a unique fashion to be described hereinafter.

In a preferred embodiment, the modular structure 10 may include a plurality of preassembled individual modules 10*a* arranged in side-by-side relation as shown in FIG. 1. These modules 10*a* can also be stacked one upon another as will be described in connection with FIG. 3 but, in any event, each such module preferably includes a plurality of walls 12 defining the perimeter of the overall structure 10, it being understood that there may be double walls 12 where two adjacent modules 10*a* abut, as shown, or a single wall formed by using only the confronting inner panels of the adjacent modules 10*a* with studs therebetween (see, e.g., FIG. 4). In addition, the modular structure 10 is advantageously provided with a floor panel 22 (see FIG. 2) and a ceiling panel 24 (see FIG. 3) substantially coextensive with the perimeter of each of the individual modules 10*a*.

Figure 4:
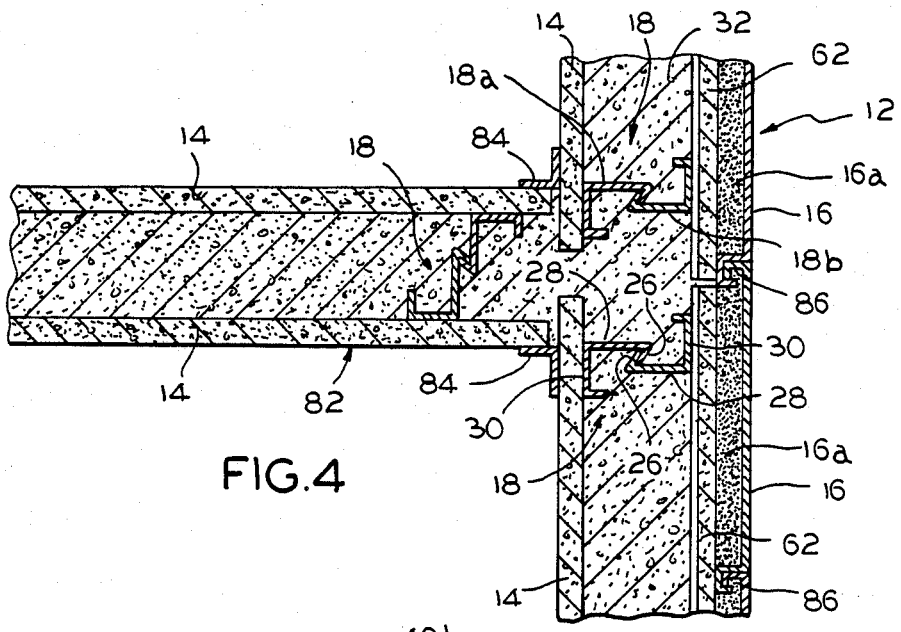
FIG. 4 is a cross sectional view illustrating the construction of the studs of the present invention.

As will be appreciated by referring to FIG. 4, the modular structure 10 preferably includes a plurality of studs 18 disposed between the inner and outer panels 14 and 16 of each of the walls 12. The means for interlocking the first and second portions 18*a* and 18*b* of each of the studs 18 in a fixed position within the cavity 20 comprises, in part, reversely bent lips 26 associated with webs 28 extending away from mounting flanges 30 and, as illustrated, the first and second portions 18*a* and 18*b* are preferably identical to one another. As shown, the mounting flanges 30 of the first portions 18*a* are provided for attachment of one of the panels 14 and the mounting flanges 30 of the second portions 18*b* are provided for attachment of the other of the panels 16.

Still referring to FIG. 4, a core material 32 is preferably disposed within the cavity 20 between the inner and outer panels 14 and 16. The core material 32, which is preferably concrete poured within the cavity 20, also comprises, in part, the interlocking means, since the concrete forces the inner and outer panels 14 and 16 away from one another for forced engagement of the reversely bent lips 26 of each of the studs 18, thus giving the studs stability both before and after the concrete sets. With this construction, the webs 28 are advantageously perforated such as at 34 (see FIG. 2) so that the concrete passes through the studs 18 to substantially fill the cavity 20.

In a preferred embodiment, the inner and outer panels 14 and 16 of the walls 12 and the first and second portions 18*a* and 18*b* of the studs 18 are formed of metal. It is also advantageous for the inner and outer panels 14 and 16 of the walls 12 to be prefinished, as will be explained in detail hereinafter. Furthermore, the outer panel 16 of at least some of the walls 12 may be constructed so as to include an insulation layer 16*a*.

Figure 2:
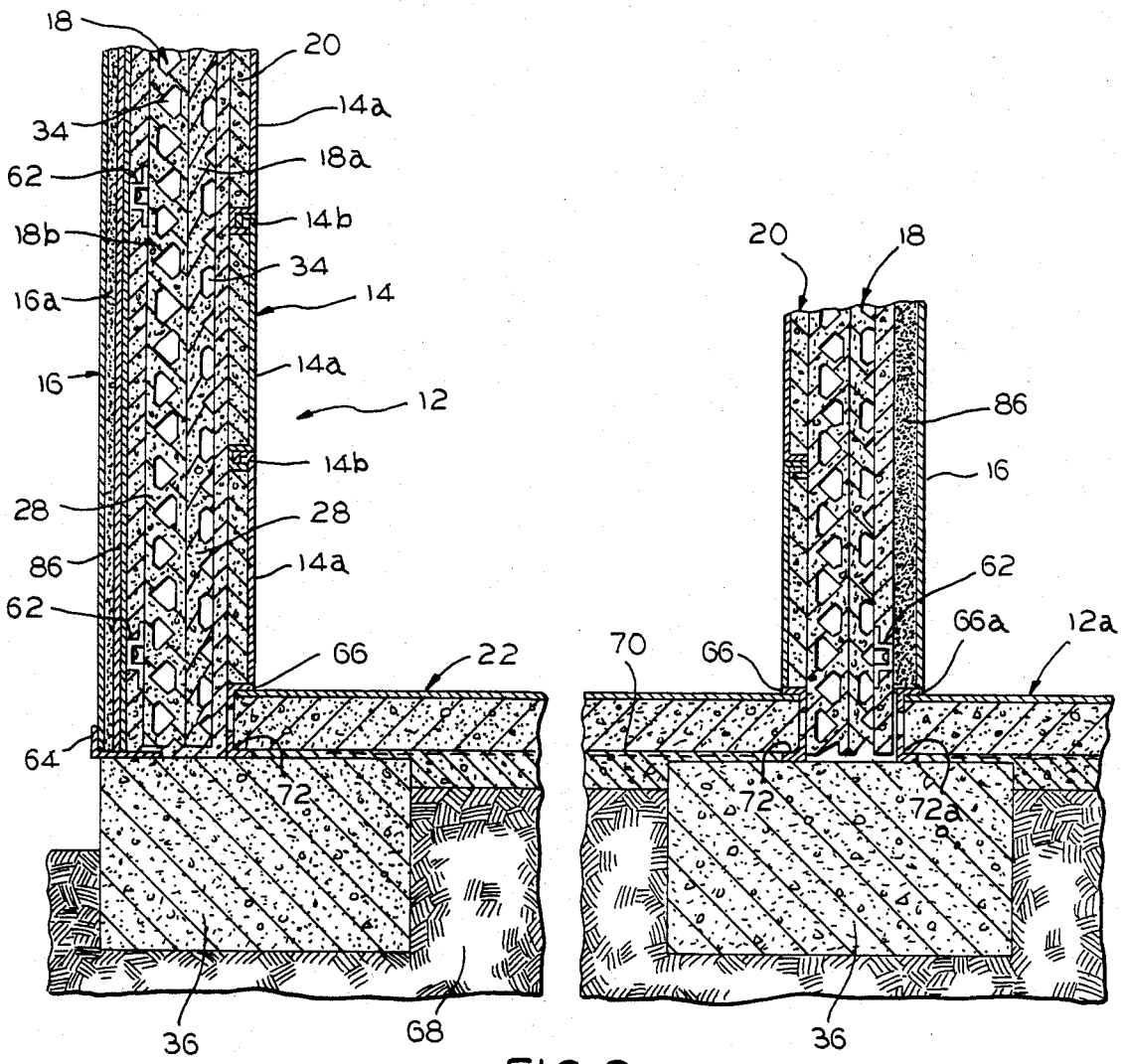
FIG. 2 is a cross sectional view taken on the line 2—2 of FIG. 1.

As will be appreciated by referring to FIG. 2, the perimeter of the modular structure 10 is preferably positioned on a foundation 36. It will be seen that the floor panel 22 may then be disposed in spaced relation above the top of the foundation 36 with the space below the surface of the floor panel being in communication with the cavities 20 between the inner and outer panels 14 and 16 so that concrete will not only substantially fill the cavities between the inner and outer panels but will also substantially fill the space below the surface of the floor panel 22. With this construction, the floor and walls of the modular structure 10, as in most permanent buildings of conventional construction, will be supported by the foundation 36.

Figure 3:
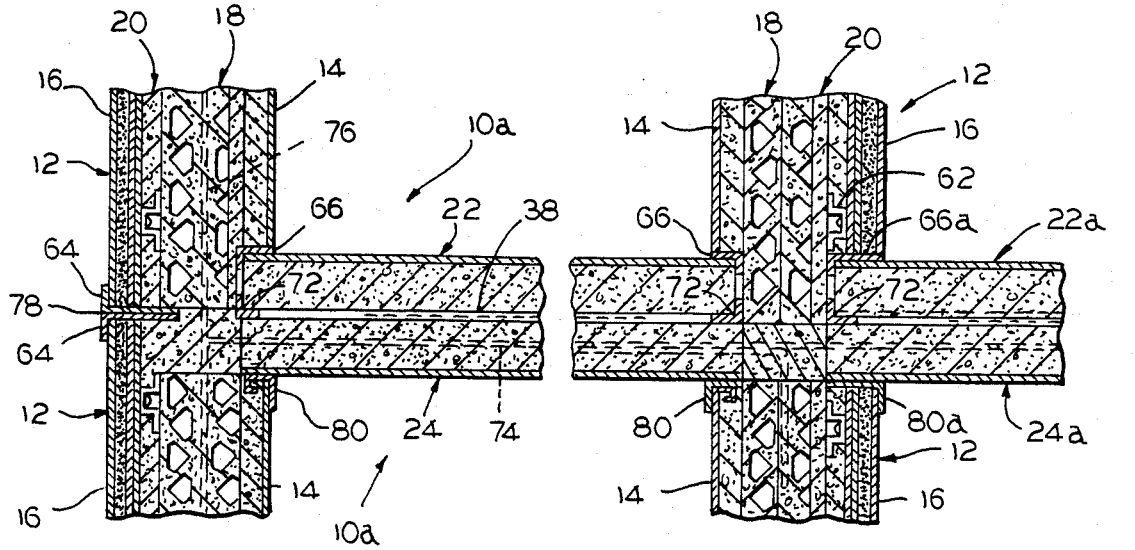
FIG. 3 is a cross sectional view illustrating one modular structure stacked on top of another.

Referring to FIG. 3, the ceiling panel 24 is preferably disposed in spaced relation below the top of the walls 12. The space above the surface of the ceiling panel 24 is then preferably in communication with the cavities 20 between the inner and outer panels 14 and 16 so that concrete will not only substantially fill the cavities between the inner and outer panels but will also substantially fill the space above the surface of the ceiling panel 24 to the top of the walls 12, i.e., to the level indicated by the reference numeral 38. As shown in FIG. 3, another individual module 10*a* may then be placed on top of the individual module 10*a* so formed.

Figure 6:
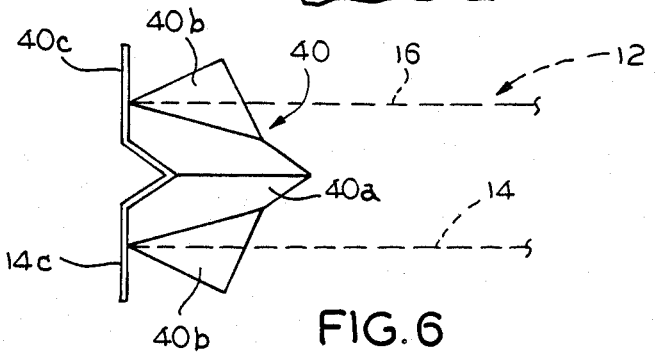
FIG. 6 illustrates a wedge in a top (A), side (B), and front (C) view.

Referring to FIG. 6, the means for interlocking the first and second portions 18*a* and 18*b* of the studs 18 in a fixed position further comprises, in part, wedge means 40 adapted to be disposed within the cavities 20 defined by the inner and outer panels 14 and 16. The wedge means, or slide blocks 40, are advantageously adapted to be disposed within the cavities 20 at preselected intervals and, as a result of the shape of the slide blocks 40, the inner and outer panels 14 and 16 are thereby forced away from one another for forced engagement of the reversely bent lips 26 of the first and second portions 18*a* and 18*b* of the studs 18. By utilizing the slide blocks 40, the inner and outer panels 14 and 16 of the walls 12 may be maintained in spaced apart relationship by a preselected distance until the concrete has been poured within the cavities 20.

Figure 5:
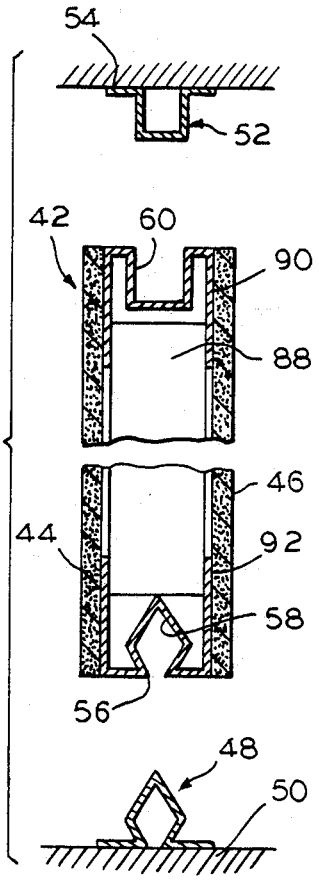
FIG. 5 is a cross sectional view illustrating retainers for a wall in a modular structure.
Figure 7:
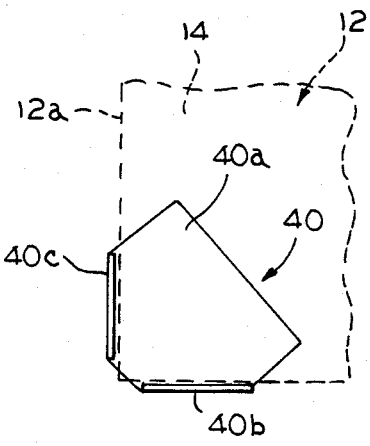
Figure 8:
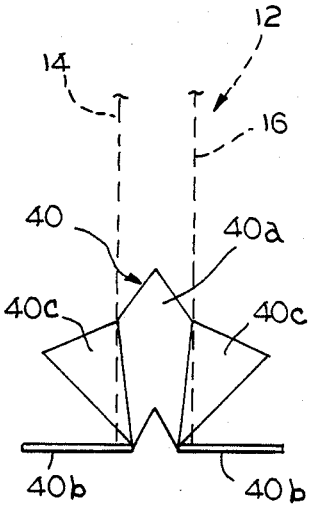

As will be appreciated by referring to FIG. 5, a modular structure in the form of an interior wall 42 is illustrated with the wall being formed with first and second exposed surfaces 44 and 46 maintained in spaced apart relation by a preselected distance. It also includes first retainer means 48 adapted to be secured to a floor 50 and adapted to cooperate with the bottom of the wall 42 so as to maintain the wall in a selected position relative to the floor. It further includes second retainer means 52 adapted to be secured to a ceiling 54 and adapted to cooperate with the top of the wall 42 so as to maintain the wall in a selected position relative to the ceiling. As shown, the first retainer means 48 comprises a spring catch engagable with the bottom of the wall 42 and the second retainer means 52 comprises a tongue member engagable with the top of the wall 42.

As will be appreciated, the bottom of the wall 42 includes an opening 56 leading to a recess 58 adapted to receive the spring catch in snap fit relationship. It will seen that in a preferred embodiment the spring catch 48 and recess 58 are generally diamond-shaped with the spring catch having a maximum width greater than the width of the opening 56 leading into the recess 58. Also as shown, the top of the wall 42 includes a mating groove 60 adapted to receive the tongue member 52 in sliding relationship.

With the features of construction outlined in detail, a unique method of constructing modular structures has been provided. The method includes providing an inner and outer panel and a stud having first and second portions. The inner panel is then secured to one of the first and second portions of the stud after which the inner and outer panels are positioned in spaced parallel relationship with the first and second portions in confronting relatively movable relationship to form a wall having a cavity therein. The method then includes interlocking the first and second portions of the stud in a fixed position within the cavity. When this has been done, the inner and outer panels of the wall are maintained in spaced apart relationship by a preselected distance.

In addition, a floor panel is preferably provided substantially coextensive with the perimeter of the structure and intergrally associated with the bottom of the walls defining the structure. Similarly, a ceiling panel is preferably provided substantially coextensive with the perimeter of the structure and intergrally associated with the top of the walls. With this arrangement, concrete may be poured until it substantially fills the space below the surface of the floor panel, the cavities in the walls, and the space above the surface of the ceiling panel to the top of the walls.

In FIG. 1, a typical floor plan for a jail or a prison has been illustrated. It will be seen that four individual modules 10*a*, each containing six cells 10*b*, have been shown for purposes of illustrating one potential application of the present invention, although it will be appreciated that the broad inventive concepts of the present invention will have far wider ranging applications and, of course, the floor plan can be modified as needed for any application. However, with reference to FIG. 1, the individual modules 10*a* have been arranged to define a central corridor 10*c* having doors 10*d* at each end.

Also as shown in FIG. 1, each cell 10*b* may include a small window 10*e* and a door 10*f* opening onto the central corridor 10*c*. It will further be appreciated that various typical arrangements for placement of toilets and lavatories have been shown for each cell with a common chase 10*g* for electrical, plumbing, ventilation and the like being formed in any of various configurations for each of two adjacent cells. While three representative chase configurations have been illustrated, it will be appreciated that these are merely presented for purposes of illustration.

When the modular structure 10 is used as a jail or prison, the spaced metal inner and outer panels 14 and 16 filled with concrete provide necessary security requirements. The windows 10*e* illustrated in FIG. 1 may then be of such a restricted size as to make it impossible for prisoners to escape and/or have bars positioned prior to final assembly so as, for instance, to be anchored in the concrete poured within the cavities 20 between the inner and outer panels 14 and 16. Similarly, the doors 10*f* may be of the conventional variety found in jails and prisons.

As for the walls dividing the cells, they may take the form of the interior wall 42 illustrated in FIG. 5. It will be appreciated, of course, that the interior walls need not provide the same magnitude of security as the exterior walls of the modular structure 10 and, as a result, the advantageous features inherent in the interior wall 42 by reason of the unique snap fit relation of elements 48 and 58 and sliding fit relation of the elements 52 and 60 may be fully utilized. However, if desired, the walls dividing cells in the individual modules 10*a* may be of any other construction including the construction of walls 12, as previously described.

Referring to FIG. 2, the outer panel 16 may be formed with an insulation layer 16*a*. It will also be seen that the outer panel 16 may be secured to the studs 18 by utilizing metal sub girts 62. The sub girts 62 preferably have a cross section such as that shown and, when the outer panel 16, the studs 18 and the sub girts 62 are all formed of metal, the sub girts 62 may be secured to the outer panel 16 by mechanical fastners or welding and the sub girts 62 may then be secured to the mounting flanges 30 of the second portions 18*b* of the studs 18 by mechanical fasteners or welding and, as a result, there need be no exterior fasteners thereby contributing to both security and aesthetics. At the top and bottom of the outer panel 16, a trim closure 64 may advantageously be provided (see also FIG. 3).

Referring to the inner wall 14, it may be formed of a plurality of flat panels 14*a* having interlocking portions as at 14*b*. The interlocking portions 14*b*, when the flat panels 14*a* and the studs 18 are constructed of metal, may be mechanically fastened or welded to the mounting flanges 30 of the first portions 18*a* of the studs 18. Additionally, a trim angle 66 may be utilized to join the floor panel 22 to the lower most flat panel 14*a* at a position spaced above the bottom of the wall 12.

As shown in FIG. 2, the foundation 36 preferably takes the form of a footing poured on compacted fill 68 to conform to the perimeter of the modular structure 10. The modular structure 10 may then, prior to pouring the concrete, be assembled and placed on the footing 36 after which the concrete may be poured to fill the cavities 20 and to fill the space below the floor panel 22 to the top of the footing 36 and to the top of the compacted fill 68 therebetween. As shown, a welded wire fabric 70 may be utilized to add reinforcement at the level of the top of the footing 36 substantially coextensive with the floor panel leg frame angles 72.

Finally, as shown in FIG. 2, another floor panel 22*a* may be secured by means of another trim angle 66*a* to the outer panel 16 of one of the walls 12 to begin another modular structure, a hall or the like.

As will be appreciated, the details described in connection with FIG. 2 are merely presented for purposes of illustration. It will be recognized, for instance, that various types of sheeting can be used for both the inner panel 14 and the outer panel 16, various means can be utilized for securing the inner and outer panels to the studs 18, various materials can be used for the inner and outer panels 14 and 16 as well as the studs 18 and sub girts 62, and the inner and outer panels may optionally include insulation layers and may be prefinished, as desired. In addition, the various trim angles, trim closures, and frame angles may be of any desired configuration.

Referring to FIG. 3, one individual module 10*a* is shown placed on top of another individual module 10*a*. In other words, this is a cross-sectional view taken at floor level between, for instance, a first and second story of a multistory modular structure. As will be appreciated, the method of construction involves completing the lower story after which the upper story is placed on top of it.

Still referring to FIG. 3, steel reinforcing 74 is utilized to tie the ceiling and walls together in the fabrication of the modular structure 10. After the steel reinforcing 74 has been put in place for the lower story, together with steel dowels 76, which are used to tie the lower and upper stories together, the concrete is poured to fill the space below the floor panel 22, the cavities 20 defined by the inner and outer panels 14 and 16 of the walls 12, and the space above the ceiling panel 24 to the top of the walls 12 of the lower story to the level indicated at 78, and the reinforcing 74 and steel dowels 76 provide additional strength for the ceiling, walls and floors of the completed assembly. Subsequently, another individual module 10*a* comprising the upper story is placed on the lower story for completion in like fashion.

As shown, a ceiling panel 24*a* may be secured to the outer panel 16 by means of a trim angle 80*a*, a trim angle 80 being used to secure the ceiling panel 24 to the inner walls 14. This arrangement is utilized to secure individual modules 10*a* in side-by-side relation, or to form a hall or other closure span for applications such as that shown in FIG. 1 where a center corridor 10*c* is utilized. Once again, the construction technique is identical to that previously described.

Referring to FIG. 4, this view illustrates the construction at a structural wall intersection. It will be appreciated that two inner panels 14 may be utilized to form a structural wall 82 intersecting with the structural wall 12 where, for instance, the wall 82 is the sole wall between adjacent individual modules 10*a* or where it is an interior, load bearing wall and, as shown, the wall 82 may be joined to another wall 12 by means of trim closures 84. Also as shown, the outer panels 16 may comprise flat vertical sheets interlocking as at 86.

Referring to FIG. 5, a prefabricated and finished interior wall 42 is illustrated. This wall may be formed of metal stubs 88 to which prefinished panels 44 and 46 may be secured such that the studs 88 do not extend entirely to the top and bottom of the panels and, as shown, sheet metal members 90 and 92 are preferably secured to the studs at the tops and bottoms thereof and extend upwardly and downwardly, respectively, to the level of the top and bottom of the wall 42. As shown, the sheet metal members 90 and 92 are formed with the groove 60 and the recess 58, respectively.

With this arrangement, the wall 42 comprises a snap-in stud wall system. The spring catch 48, which comprises a base catch trim, is formed to fit within the recess 58 in snap fit relationship and the groove 60, which comprises a slotted top, is adapted to cooperate with the tongue member 52 in sliding relationship so that the slotted top allows for vertical tolerances. With this arrangement, the prefabricated, prefinished interior wall 42 may be quickly assembled during modular assembly.

Finally, referring to FIG. 6, the slide block 40 is preferably made from one retangular piece of steel. It will be appreciated that the purpose of the slide block 40 is to align the module on the foundation and to keep the studs in interlocked relationship before and during the pouring of concrete. After the concrete has been poured, the slide blocks disposed within the walls of the modular structure remain as a part of the completed assembly.

As will be appreciated, the panels and studs may be made of light gauge metals. For instance, the panels may be roll formed light gauge steel manufactured in units cut to length, prepunched and prefinished and, in like fashion, the studs may be formed of light gauge steel and perforated as described hereinabove. With this construction, the modular structure, prior to pouring the concrete, comprises a unique stay-in-place form.

As a result, the individual modules may be assembled at one location and shipped to another location adjacent the site for the modular structure. The individual preassembled modules may then be set onto a foundation that has previously been poured at the site, small aggregate concrete may then be poured into the individual modules constituting a first floor of the modular structure, and after the concrete has set, an additional set of individual preassembled modules may be placed on top of the first floor and assembled in like fashion on a repeated basis for each subsequent floor comprising the modular structure. As previously mentioned, any desired configuration may utilize the unique aspects of the present invention.

With the features of the present invention, the necessary steps in the process are performed at points of optimum advantage. These include considerations of materials, space and weight since the panels and components are manufactured in units that may be cut to length, prepunched, and prefinished at the time of manufacturing. The panels and components may then be shipped to a panelized assembly plant where they are assembled into walls consisting of inner and outer panels, floor panels, and ceiling panels with the necessary welding, screwing and sealing operations taking place in plant where established jigs and fixtures may maintain the trueness and other elements required to better assemble the panels. The walls, floor panels and ceiling panels may then be shipped to the actual job site where, in a temporary facility, they may be formed into three dimensional modules with all plumbing, heating, electrical, ventilation, doors, windows and the like installed. These individual modules are then set onto the foundation with their interiors and/or exteriors prefinished, and the entire first floor of a modular structure is then poured with concrete. Optionally, the manufacturer might choose to assemble the modules and ship directly to the job site depending on local logistics by transporting on over-the-road lowboy trailers.

As the individual modules are set onto the foundation, they automatically interlock through the special studs in cooperation with the slide blocks. After the modules have been placed and, in some instances, preassembled walls and hallway panels assembled, the concrete which is then poured automatically forces the inner and outer panels of the walls away from one another engaging the special studs and, due to the nature of the studs, the concrete flows between the studs and encases them. Also, as previously described, the concrete fills underneath the floor panels to rigidize the assembly.

Among the advantages to the present invention is allowing the more tedious finishing processes to be controlled in a plant condition. After the assembly of the individual modules, the modules may be transported to the job site for completion of assembly to render the modules a rigid structure. While well suited for many applications, the modular structure is fully capable of ensuring the security requirements and providing the necessary fireproof structure for prisons, banks and the like.

While a detailed description has been set forth for purposes of illustration, the details herein given may be varied by those skilled in the art without departing from the spirit and scope of the invention, as defined in the claims appended hereto.

I claim:

1. An interior wall, comprising:

a stud having a pair of panels secured thereto, said stud being disposed between said panels and interiorly thereof and said panels each extending above and below said stud at the top and bottom thereof, said panels cooperating with said stud to define top and bottom retainer receiving recesses;

first retainer means including a first portion secured to said stud at the bottom thereof inwardly of said panels in said bottom recess, said first portion of said first retainer means extending downwardly from said stud to a point adjacent the bottom of said panels so as to be substantially entirely concealed within said bottom recess, said first retainer means including a second portion secured to a floor;

said first portion of said first retainer means including an opening leading to said bottom recess, said second portion of said first retainer means including means for cooperating with said first portion thereof in snap-fit and totally hidden fashion after insertion through said opening to maintain said wall in a selected position relative to said floor; and second retainer means including a first portion secured to said stud at the top thereof inwardly of said panels in said top recess, said first portion of said second retainer means extending upwardly from said stud to a point adjacent the top of said panels so as to be substantially entirely concealed within said top recess, said second retainer means including a second portion secured to a ceiling;

said first portion of said second retainer means including an opening leading to said top recess, said second portion of said second retainer means including means for cooperating with said first portion thereof in slide-fit and totally hidden fashion after insertion through said opening to maintain said wall in a selected position relative to said ceiling;

said first and second retainer means comprising the only retainer means for said interior wall.

2. The interior wall as defined by claim 1 wherein said second portion of said first retainer means comprises a spring catch, said first portion of said first retainer means being formed to have a maximum width greater than the width of said opening leading into said bottom recess, said bottom recess being sized and shaped to receive said spring catch in snap-fit relationship.

3. The interior wall as defined by claim 2 wherein said spring catch and said first portion of said first retainer means are generally diamond shaped.

4. The interior wall as defined by claim 1 wherein said second portion of said second retainer means comprises a tongue member, said first portion of said second retainer means being adapted to receive said tongue member in a groove defined thereby, said tongue member cooperating with said groove in sliding relationship to accommodate a range of tolerances.

5. The interior wall as defined by claim 1 wherein said panels of said wall are prefinished.

* * * * *